US008667790B2

(12) United States Patent
Zhang

(10) Patent No.: US 8,667,790 B2
(45) Date of Patent: Mar. 11, 2014

(54) UNIVERSAL HOLE CUTTER

(76) Inventor: Yingen Zhang, Chumen Town (CN)

( * ) Notice: Subject to any disclaimer, the term of this patent is extended or adjusted under 35 U.S.C. 154(b) by 868 days.

(21) Appl. No.: 12/851,846

(22) Filed: Aug. 6, 2010

(65) Prior Publication Data

US 2011/0297244 A1 Dec. 8, 2011

(30) Foreign Application Priority Data

Jun. 2, 2010 (CN) ..... 2010 1 0190033

(51) Int. Cl.
*F16D 31/02* (2006.01)

(52) U.S. Cl.
USPC ..... 60/477

(58) Field of Classification Search
USPC ..... 60/385, 400, 477–482; 137/218; 277/632
See application file for complete search history.

(56) References Cited

U.S. PATENT DOCUMENTS

| | | | | |
|---|---|---|---|---|
| 2,255,984 | A * | 9/1941 | Pfauser | 60/478 |
| 3,730,057 | A * | 5/1973 | Friden | 92/110 |
| 6,276,136 | B1 * | 8/2001 | Oishi et al. | 60/547.1 |
| 7,685,925 | B2 * | 3/2010 | Sawdon et al. | 91/189 R |

FOREIGN PATENT DOCUMENTS

| | | | |
|---|---|---|---|
| CN | 1506176 | A | 6/2004 |
| CN | 101003135 | A | 7/2007 |

* cited by examiner

*Primary Examiner* — Edward Look
*Assistant Examiner* — Logan Kraft
(74) *Attorney, Agent, or Firm* — Minder Law Group; Willy H. Wong

(57) ABSTRACT

The present invention discloses a universal hole cutter in the field of mechanics, comprising an oil pump body, an oil cylinder and an oil storage chamber, in which the oil pump body could be fixedly connected with the oil storage chamber and the oil paths thereof could be communicated with each other. A pressure mechanism could be provided on the oil pump body for pressing the power oil within the oil storage chamber into the oil cylinder. The oil cylinder could be fixedly threaded with a pipe joint communicating with the internal cavity of the oil cylinder, and the pipe joint could be communicated with the oil pump body through a rigid movable linkage mechanism which could rotate the oil cylinder with respect to the oil pump body. Compared to the prior art, in the universal hole cutter thus described, the thread connection of the pipe joint and the oil cylinder is reliable and convenient. Furthermore, no welding site exists between the pipe joint and the oil cylinder, which makes a tidy connection and an aesthetic appearance of the complete hole cutter. The universal hole cutter tends not to have a blocking defect and has a good reliability in use.

8 Claims, 4 Drawing Sheets

UNIVERSAL HOLE CUTTER

BACKGROUND OF THE INVENTION

1. Field of Invention

The present invention relates to a hole cutter for making holes in a metal sheet, in particular, to a universal hole cutter in the field of mechanics.

2. Related Art

In order for making holes in a workpiece or metal sheet, people have designed various kinds of hydraulic hole cutters. The existing hole cutters are generally consisted of a oil cylinder and a oil pump body in which the oil cylinder is directly fixed to the oil pump body. In these hole cutters, the oil cylinder could not rotate with respect to the oil pump body, so the oil pump body has to be move together when the position of the oil cylinder is to be changed. Therefore, the applicability of said hold cutters is relatively poor in different occasions of use.

To address the afore-mentioned problems, someone has designed a hole cutter in which the oil cylinder could move with respect to the oil pump body. For example, a hydraulic hole cutter is disclosed in a Chinese Patent CN02150961.1, comprising a cylinder, a hydraulic pump and a hose, in which both ends of the hose are respectively communicated with the cylinder and the hydraulic pump. During operation, the hose could be arbitrarily bended, and thus the position of the cylinder could be adjusted even in occasions with a smaller space, thereby effectively improving the applicability of the hydraulic hole cutter. However, the hose could not directly support the cylinder, which brings a problem of supporting the cylinder during use. In this regard, such a hydraulic hole cutter could not be conveniently used. In addition, the hose has such a limited strength that it tends to be detached or broken due to hauling during moving processes.

To this end, the applicant once disclosed a universal hole cutter in a Chinese Patent Application 200710036580.X, comprising an oil cylinder, an oil pump body and an oil storage body, in which the oil pump body is directly fixedly connected to the oil storage body and the oil paths of the two are in communication. A rigid movable linkage mechanism is provided between the oil cylinder and the oil pump body, via which the oil cylinder is communicated with the oil pump body and the oil cylinder could rotate with respect to the oil pump body. A pressure mechanism is set on the oil pump body, through which the power oil within the oil storage chamber is pressed into the oil cylinder. The oil thus pressed would drive the piston rod in the oil cylinder to move when it enters the oil cylinder. Since a male die is fixedly connected to the piston rod for making holes, the male die could be operated for making holes after it moves.

The pressure mechanism includes a movable handle and a stationary handle. The movable handle is hinged to the oil pump body, and the stationary handle is fixedly connected to the oil pump body. A plunger is connected with the movable handle. The plunger could be inserted into a plunger hole of the oil pump body. The plunger hole is communicated with the oil inlet passage. The plunger would move up and down repeatedly as the movable handle is turned up and down repetitively, so that the power oil within the oil storage chamber would be pressed into the oil cylinder through the oil inlet passage.

In the above universal hole cutter, the oil cylinder is made of iron and steel material. In this case, the oil cylinder has a large weight and thus could not be conveniently used. Moreover, the oil inlet bolt is welded to the oil cylinder, and the oil path between the oil inlet bolt and the oil cylinder is bended.

According to such a configuration, the oil path tends to be blocked, and the welding site of the oil inlet bolt and the oil cylinder does not have an aesthetic appearance.

SUMMARY OF THE INVENTION

It is therefore an object of the present invention to provide a universal hole cutter which could be conveniently used and has an aesthetic appearance, so as to address the problems existing in the prior art.

To accomplish the objects thus mentioned, the present invention provides a universal hole cutter, comprising an oil pump body, an oil cylinder and an oil storage chamber, in which the oil pump body could be fixedly connected with the oil storage chamber and the oil paths thereof could be communicated with each other. A pressure mechanism could be provided on the oil pump body for pressing the power oil within the oil storage chamber into the oil cylinder. The oil cylinder could be fixedly threaded with a pipe joint communicating with the internal cavity of the oil cylinder, and the pipe joint could be communicated with the oil pump body through a rigid movable linkage mechanism which could rotate the oil cylinder with respect to the oil pump body.

According to said universal hole cutter, the position of the oil cylinder relative to the oil pump body could be freely adjusted via the rig movable linkage mechanism. In particular, the oil cylinder merely has to be located in the universal hole cutter to make holes in narrow operation sites.

The power oil could be driven into the oil cylinder from the oil storage chamber with the pressure mechanism. The piston in the oil cylinder would drive the male die for making holes to move and thus accomplish making holes. In the universal hole cutter, the pipe joint is threaded with the oil cylinder, generating a convenient and reliable connection.

According to certain exemplary embodiments of the universal hole cutter, the rigid movable linkage mechanism is a rigid connection pipe. One end of the connection pipe could be communicated with the oil storage chamber and the other end of the connection pipe could be hinged to the pipe joint. The oil paths of said oil cylinder and oil pump body are communicated with each other through the pipe joint and the connection pipe.

In this case, the power oil within the oil pump body could enter the oil cylinder via the pipe joint and the connection pipe. In addition, the oil cylinder could rotate with respect to the oil pump body since said other end of the connection pipe is hinged to the pipe joint.

According to certain exemplary embodiments of the universal hole cutter, the connection pipe is bended.

According to certain exemplary embodiments of the universal hole cutter, a projected annular connection piece could be set on one side of the oil cylinder, and said pipe joint could be connected to the connection piece.

The connection piece has such a relatively large thickness that the surface of the connecting site of the pipe joint and the connection piece is enlarged, thereby improving the reliability of the connection between the pipe joint and the connection piece of the oil cylinder.

According to certain exemplary embodiments of the universal hole cutter, a straight hole could be provided at said connection piece extending along the radial direction of the oil cylinder. The inner end of the straight hole could be communicated with the internal cavity of the oil cylinder, and the outer end of the straight hole could be connected with said pipe joint.

In such a situation, the power oil could pass through the pipe joint and the straight hole in sequence along a linear direction and then enter the oil cylinder. Therefore, the resistance would not be disadvantageously large while the oil flows in the bended oil path. Moreover, the oil path tends not to be blocked due to the movement of the power oil in the linear direction.

According to certain exemplary embodiments of the universal hole cutter, a sealant could be provided at the thread connection site of said pipe joint and the connection piece.

The pipe joint would not be released or detached from the connection piece of the oil cylinder with such a sealant.

According to certain exemplary embodiments of the universal hole cutter, the sealant is an anaerobic adhesive.

The anaerobic adhesive is a mono-component sealing adhesive made by using the polymerization inhibition principle of oxygen to free radicals, which could be used not only for adhering but also for sealing. The adhesive coating surface could polymerize and cure under room temperature where there exists a catalyst when it is isolated from air. Therefore, by using the anaerobic adhesive, not only the pipe joint could be reliably connected with the connection piece, but also a sealing effect could be achieved.

According to certain exemplary embodiments of the universal hole cutter, a projected stopper could be set on the side of said pipe joint. A seal gasket could be positioned on the pipe joint and tightly pressed between the stopper and the connection piece.

In this situation, the contact surface between the stopper of the pipe joint and the connection piece of the oil cylinder could be protected from being abraded by using the seal gasket. Moreover, a sealing effect could be achieved between the pipe joint and the connection piece with the seal gasket.

According to certain exemplary embodiments of the universal hole cutter, the seal gasket could be consisted of an inner ring made of rubber and an outer ring made of metal, and the inner ring could be positioned next to the inner side of the outer ring. Thus, a sealing effect would be achieved between the pipe joint and the connection piece and the contact surface therebetween would be protected by using the inner ring, and the strength of the whole seal gasket would be enhanced by using the outer ring.

According to certain exemplary embodiments of the universal hole cutter, the outer ring of said seal gasket is made of steel materials. The steel materials have a low price and provide the outer ring of the seal gasket with a high strength.

According to certain exemplary embodiments of the universal hole cutter, said oil cylinder is made of aluminum alloy materials.

According to certain exemplary embodiments of the universal hole cutter, said oil cylinder is made of magnesium alloy materials. The oil cylinder made from aluminum alloys or magnesium alloys has a relatively small weight.

Compared to the prior art, in the universal hole cutter thus described, the thread connection of the pipe joint and the oil cylinder is reliable and convenient. Furthermore, no welding site exists between the pipe joint and the oil cylinder, which makes a tidy connection and an aesthetic appearance of the complete hole cutter.

In addition, the oil path on the oil cylinder is implemented to be a straight hole which tends not to have a blocking defect and thereby improves the reliability of the complete hole cutter in use. Further, the oil cylinder made from aluminum alloys or magnesium alloys has a small weight, and the complete hole cutter could be conveniently used.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus are not limitative of the present invention, and wherein.

DETAILED DESCRIPTION OF THE INVENTION

Figure 1:
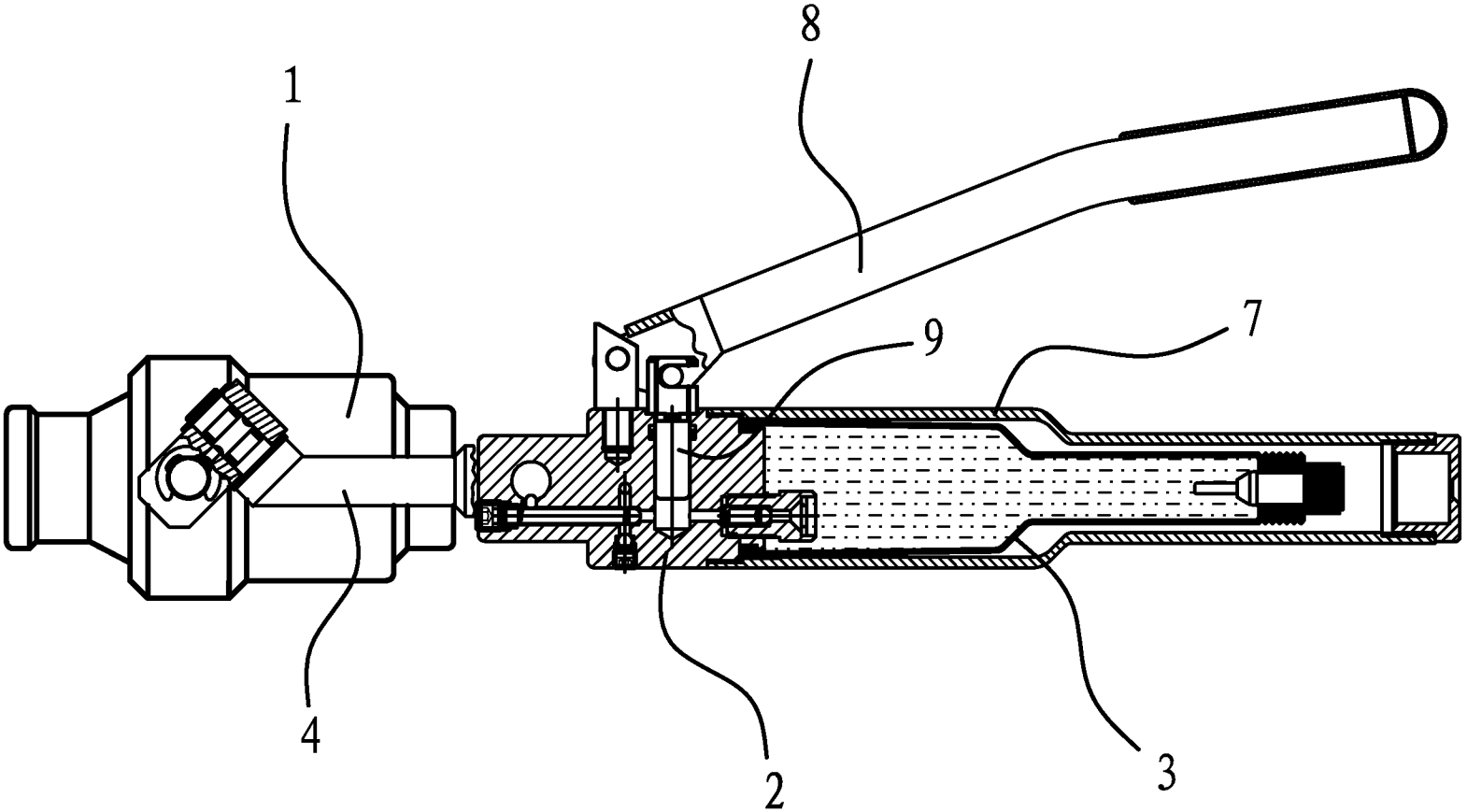
FIG. 1 is a structural diagram of the universal hole cutter.

Embodiments of the present invention will be described in detail below with reference to the drawings, where like reference numerals indicate identical or functionally similar elements.

Figure 2:
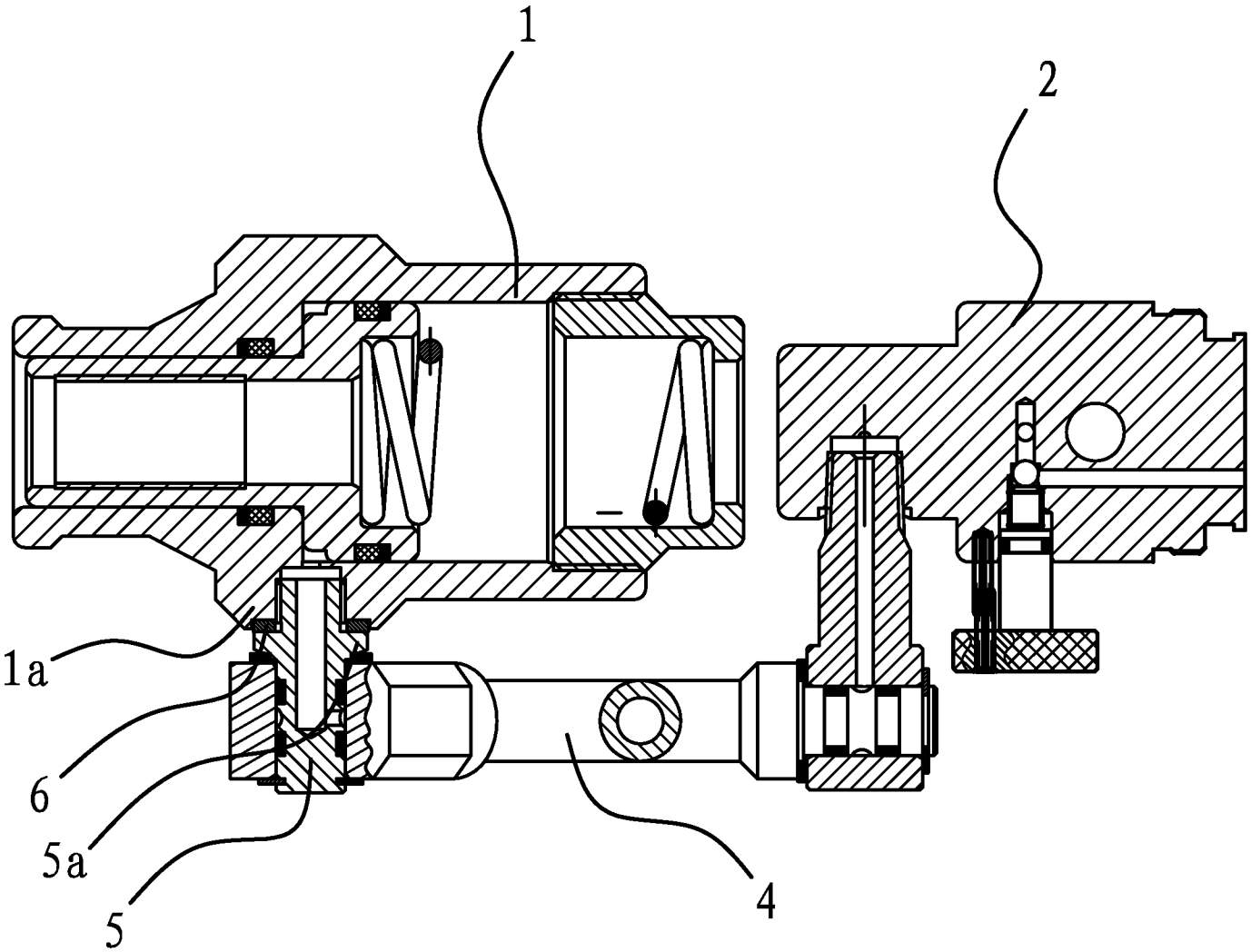
FIG. 2 is a sectional structural diagram of the oil cylinder and the oil pump body of the universal hole cutter.

As shown in FIGS. 1 and 2, the universal hole cutter includes an oil pump body 2, an oil cylinder 1 and an oil storage chamber 3. The oil pump body 2 is fixedly connected to the oil storage chamber 3, and the oil path between the oil pump body 2 and the oil storage chamber 3 is in communication. A pressure mechanism is provided on the oil pump body 2 for pressing the power oil within the oil storage chamber 3 into the oil cylinder 1.

The pressure mechanism includes a movable handle 8 and a stationary handle 7. The movable handle 8 is hinged to the oil pump body 2, and the stationary handle 7 is fixedly connected with the oil pump body 2. A plunger 9 is connected to the movable handle 8. The plunger 9 is inserted into a plunger hole of the oil pump body 2. The plunger hole is communicated with the oil inlet passage. The plunger 9 would move up and down repeatedly as the movable handle 8 is turned up and down repetitively. In this case, the power oil within the oil storage chamber 3 would be pressed into the oil cylinder 1 through the oil inlet passage.

Figure 3:
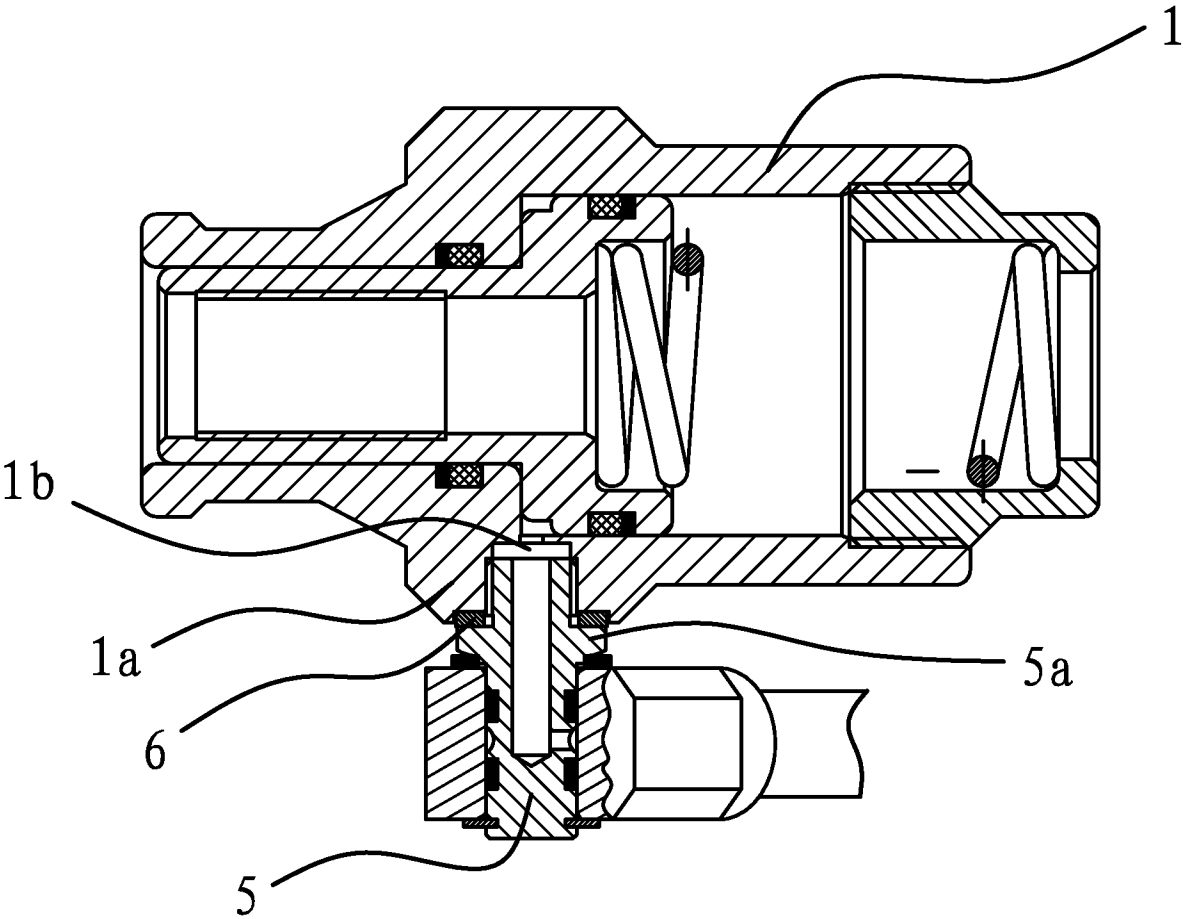
FIG. 3 is a sectional structural diagram of the oil cylinder of the universal hole cutter.

As shown in FIGS. 2 and 3, the oil cylinder 1 is configured as a cylindrical shape. A projected annular connection piece 1*a* is set on one side of the oil cylinder 1. A straight hole 1*b* is provided at the connection piece 1*a* extending along the radial direction of the oil cylinder 1. The inner end of the straight hole 1*b* is communicated with the internal cavity of the oil cylinder 1, and the outer end of the straight hole 1*b* is fixedly threaded with a pipe joint 5. In this embodiment, the oil cylinder 1 is made of aluminum alloy materials. However, the coil cylinder 1 could also be made of magnesium alloy materials as required.

The oil cylinder 1 is connected with the oil pump body 2 via a rigid movable linkage mechanism.

The rig movable linkage mechanism is implemented to be a rigid connection pipe 4. One end of the connection pipe 4 is communicated with the oil storage chamber 3, and the other end of thereof is hinged to the pipe joint 5. Furthermore, the oil path of the oil cylinder 1 is communicated with that of the oil pump body 2 via the pipe joint 5 and the connection pipe 4. In this embodiment, the connection pipe 4 is bended.

An anaerobic adhesive is provided at the thread connection site of the pipe joint 5 and the connection piece 1*a*.

Figure 4:
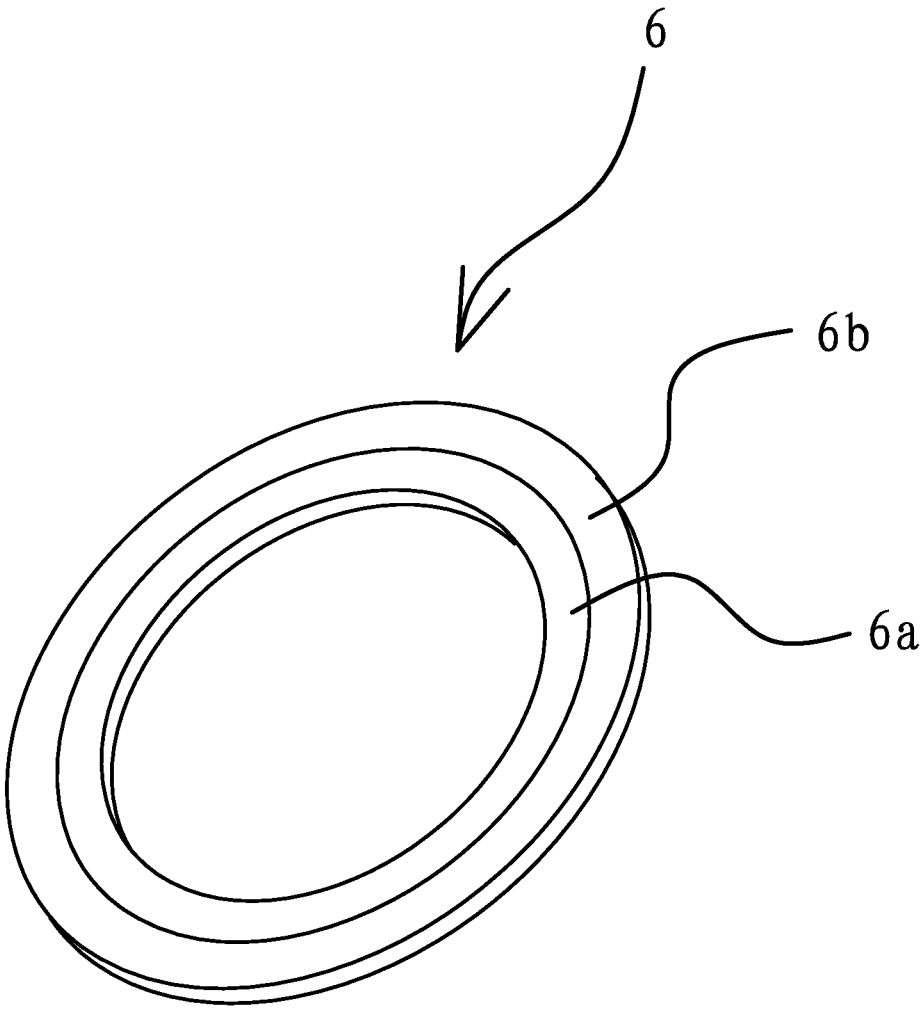
FIG. 4 is a structural stereogram of the seal gasket of the universal hole cutter.

A projected stopper 5*a* is set on the side of the pipe joint 5, and a seal gasket 6 is positioned on the pipe joint 5 and pressed between the stopper 5*a* and the connection piece 1*a* tightly. The seal gasket 6 is consisted of an inner ring 6*a* made of rubber and an outer ring 6*b* made of metal. The inner ring 6*a* is positioned next to the inner side of the outer ring 6*b*, referring to FIG. 4. In this embodiment, the outer ring of the seal gasket is made of steel materials.

When the universal hole cutter thus described is put in use, the power oil within the oil storage chamber 3 is pressed into the oil cylinder 1 by operating the pressure mechanism. The piston in the oil cylinder 1 would move driven by the power oil and bring the male die for making holes to move. Therefore, holes are made correspondingly. In the aforementioned process, the power oil within the oil storage chamber 3 would pass through the connection pipe 4 and the pipe joint 5 in sequence and then enter the oil cylinder 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

LIST OF REFERENCE NUMERALS

1 oil cylinder
1*a* connection piece
1*b* straight hole
2 oil pump body
3 oil storage chamber
4 connection pipe
5 pipe joint
5*a* stopper
6 seal gasket
6*a* inner ring
6*b* outer ring
7 stationary handle
8 stationary handle
9 plunger

The invention claimed is:

1. A universal hole cutter, comprising:

an oil cylinder (1) fixedly threaded with a pipe joint (5) communicating with the internal cavity of the oil cylinder;

a projected annular connection piece (1*a*) set on one side of the oil cylinder (1) and connected to the pipe joint (5);

a projected stopper (5*a*) set on a side of the pipe joint (5);

a seal gasket (6) positioned on the pipe joint (5) and tightly pressed between the stopper (5*a*) and the connection piece (1*a*);

an oil pump body (2) in communication with the pipe joint (5) through a rigid movable linkage mechanism that is capable of rotating the oil cylinder (1) with respect to the oil pump body (2);

an oil storage chamber (3) fixedly connected to the oil pump body (2), with oil paths thereof in communication with each other; and a pressure mechanism provided on the oil pump body (2) for pressing power oil within the oil storage chamber (3) into the oil cylinder (1);

wherein the rigid movable linkage mechanism is a rigid connection pipe (4), a first end of the connection pipe (4) is in communication with the oil storage chamber (3) and a second end of the connection pipe (4) is hinged to the pipe joint (5), and oil paths of the oil cylinder (1) and oil pump body (2) are in communication with each other through the pipe joint (5) and the connection pipe (4); and wherein the seal gasket (6) consists of an inner ring (6*a*) made of rubber and an outer ring (6*b*) made of metal, and the inner ring (6*a*) is positioned next to the inner side of the outer ring (6*b*).

2. The universal hole cutter of claim 1, further comprising:

a straight hole (1*b*) provided at the connection piece (1*a*) extending along a radial direction of the oil cylinder (1), wherein an inner end of the straight hole (1*b*) is in communication with an internal cavity of the oil cylinder (1), and an outer end of the straight hole (1*b*) is connected with said pipe joint (5).

3. The universal hole cutter of claim 2, further comprising:

a sealant provided at a thread connection site of the pipe joint (5) and the connection piece (1*a*).

4. The universal hole cutter of claim 3, wherein the sealant is an anaerobic adhesive.

5. The universal hole cutter as claimed in claim 4, wherein the outer ring (6*b*) of said seal gasket (6) is made of steel materials.

6. The universal hole cutter as claimed in claim 3, wherein the outer ring (6*b*) of said seal gasket (6) is made of steel materials.

7. The universal hole cutter as claimed in claim 2, wherein the outer ring (6*b*) of said seal gasket (6) is made of steel materials.

8. The universal hole cutter as claimed in claim 1, wherein the outer ring (6*b*) of said seal gasket (6) is made of steel materials.

* * * * *